US011208184B2

(12) United States Patent
Chen

(10) Patent No.: US 11,208,184 B2
(45) Date of Patent: Dec. 28, 2021

(54) DIVING GOGGLES

(71) Applicant: Sunny Stationery Product(Shenzhen) Co., Ltd., Shenzhen (CN)

(72) Inventor: Dexiang Chen, Shenzhen (CN)

(73) Assignee: Sunny Stationery Product(Shenzhen) Co., Ltd., Shenzhen (CN)

( * ) Notice: Subject to any disclaimer, the term of this patent is extended or adjusted under 35 U.S.C. 154(b) by 150 days.

(21) Appl. No.: 16/600,022

(22) Filed: Oct. 11, 2019

(65) Prior Publication Data

US 2021/0107610 A1 Apr. 15, 2021

(51) Int. Cl.
*B63C 11/12* (2006.01)

(52) U.S. Cl.
CPC ..... *B63C 11/12* (2013.01); *B63C 2011/128* (2013.01)

(58) Field of Classification Search
CPC ..... B63C 11/12
USPC ..... 405/186; 351/43; 2/441, 443
See application file for complete search history.

(56) References Cited

U.S. PATENT DOCUMENTS 4,056,853 A * 11/1977 Bottazzini ..... G02C 1/06 2/443
5,479,917 A * 1/1996 Hsieh ..... B63C 11/12 128/200.29
5,523,804 A * 6/1996 Nolan ..... B63C 11/12 351/41
5,564,130 A * 10/1996 Feng ..... B63C 11/12 128/207.12
5,638,552 A * 6/1997 Fujima ..... B63C 11/12 2/428
5,819,321 A * 10/1998 Wang ..... B63C 11/12 2/428
6,192,523 B1 * 2/2001 Pan ..... A61F 9/025 2/428
6,921,165 B1 * 7/2005 Feng ..... A63B 33/002 2/428
7,181,778 B1 * 2/2007 Garralfa ..... A61F 9/025 2/426
7,699,462 B2 * 4/2010 Godoy ..... A63B 33/002 351/43
8,845,093 B1 * 9/2014 Shieh ..... B63C 11/12 351/43
2006/0107446 A1 * 5/2006 Shiue ..... A63B 33/002 2/428
2006/0117468 A1 * 6/2006 Lan ..... B63C 11/12 2/426

(Continued)

FOREIGN PATENT DOCUMENTS

JP 2019094030 * 6/2019 ..... B63C 11/12

*Primary Examiner* — Frederick L Lagman
(74) *Attorney, Agent, or Firm* — Westbridge IP LLC

(57) ABSTRACT

The present disclosure provides diving goggles, which include: a mask assembly, including a mounting hole, and a dismounting hole passing through a side wall of the mounting hole; a lens, installed in the mounting hole; a pressing ring, detachably embedded in one end of the mounting hole to fix the lens, the dismounting hole facing an outer peripheral wall of the pressing ring; and a detaching component, mounted on the mask assembly, one end of the detaching component passing through the dismounting hole and resisting against the outer peripheral wall of the pressing ring, for detaching the pressing ring from the mounting hole.

18 Claims, 4 Drawing Sheets

(56) References Cited

U.S. PATENT DOCUMENTS

| | | | | |
|---|---|---|---|---|
| 2008/0074607 | A1* | 3/2008 | Godoy | B63C 11/12 351/43 |
| 2009/0165191 | A1* | 7/2009 | Kuroda | A63B 33/00 2/428 |
| 2015/0143619 | A1* | 5/2015 | Cross | A63B 33/002 2/427 |
| 2016/0327810 | A1* | 11/2016 | Cross | G02C 9/00 |
| 2019/0146240 | A1* | 5/2019 | Chen | A63B 33/002 351/43 |

* cited by examiner

DIVING GOGGLES

TECHNICAL FIELD

The present disclosure relates to the technical field of diving equipment, in particular to diving goggles.

BACKGROUND

Outdoor activities are becoming more and more abundant with the gradual improvement of people's living standards Many diving enthusiasts dive with various equipment such as goggles. However, in real life, nearsighted diving enthusiasts may be in a lot of trouble when wearing goggles. For example, lenses of the current goggles cannot be disassembled and replaced at will, which brings great troubles to nearsighted diving enthusiasts, especially those with different myopia levels in both eyes.

SUMMARY

The main objective of the present disclosure is to provide diving goggles, aiming at solving the technical problem of how to replace the lens of the diving goggles.

To achieve the above objective, the diving goggles provided by the present disclosure includes:

a mask assembly, including a mounting hole, and a dismounting hole passing through a side wall of the mounting hole;

a lens, installed in the mounting hole;

a pressing ring, detachably embedded in one end of the mounting hole to fix the lens, the dismounting hole facing an outer peripheral wall of the pressing ring; and a detaching component, mounted on the mask assembly, one end of the detaching component passing through the dismounting hole and resisting against the outer peripheral wall of the pressing ring, for detaching the pressing ring from the mounting hole.

Further, the detaching component includes an elastic arm extending along a radial direction of the dismounting hole, a free end of the elastic arm is located on an outer side of the dismounting hole along the axial direction and is configured to move elastically to approach the dismounting hole, and the free end of the elastic arm is provided with a protruding rib protruded towards the dismounting hole, the protruding rib passes through the dismounting hole and resists against the outer peripheral wall of the pressing ring.

Further, the dismounting hole is provided in a top of the mask assembly, and the detaching component is installed at the top of the mask assembly.

Further, the detaching component includes a fixing buckle, and a number of the mounting holes is two, the fixing buckle is installed between the two mounting holes; and the number of the elastic arm is two, and the two elastic arms are connected to both sides of the fixing buckle respectively.

Further, the pressing ring is embedded in a front end of the mounting hole.

Further, a detaching step is concavely provided at a top of a rear end of the pressing ring, and the protruding rib is configured to resist against the detaching step.

Further, a fixing step is formed at the front end of the mounting hole, the rear end of the pressing ring is enclosed with the fixing step to form a receiving groove extending along a circumferential direction, and the lens is embedded in the receiving groove.

Further, a connecting rib is protruded at a front end of the outer peripheral wall of the pressing ring, a free end of the connecting rib extends rearwards to form a positioning rib, and the mask assembly is concavely provided with a positioning groove matched with the positioning rib.

Further, the outer peripheral wall of the pressing ring is protruded with a fixing rib, and an inner wall of the mounting hole is provided with a fixing groove matched with the fixing rib.

Further, a free end of the protruding rib is protruded with a clamping member, and the clamping member is clamped with an inner wall of the mounting hole.

In the present disclosure, the lens of the diving goggles is fixed in the mounting hole of the mask assembly through the pressing ring. The mask assembly defines the dismounting hole passing through the side wall of the mounting hole, the detaching component passes through the dismounting hole to resist against the pressing ring. The lens can be easily removed and replaced by pressing the outer end of the detaching component. In detail, when the outer end of the detaching component is pressed, the detaching component presses the pressing ring to make the pressing ring to be deformed and escaped from the mounting hole, and the lens is free and can be removed and replaced easily. When it needs to mount the lens, the lens can be put into the mounting hole first, and the pressing ring is embedded into the mounting hole to press the side surface of the lens to fix the lens. Therefore, the lens can be replaced conveniently.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only about some embodiments of the present disclosure, and persons of ordinary skill in the art can derive other drawings from the accompanying drawings without creative efforts.

Figure 1:
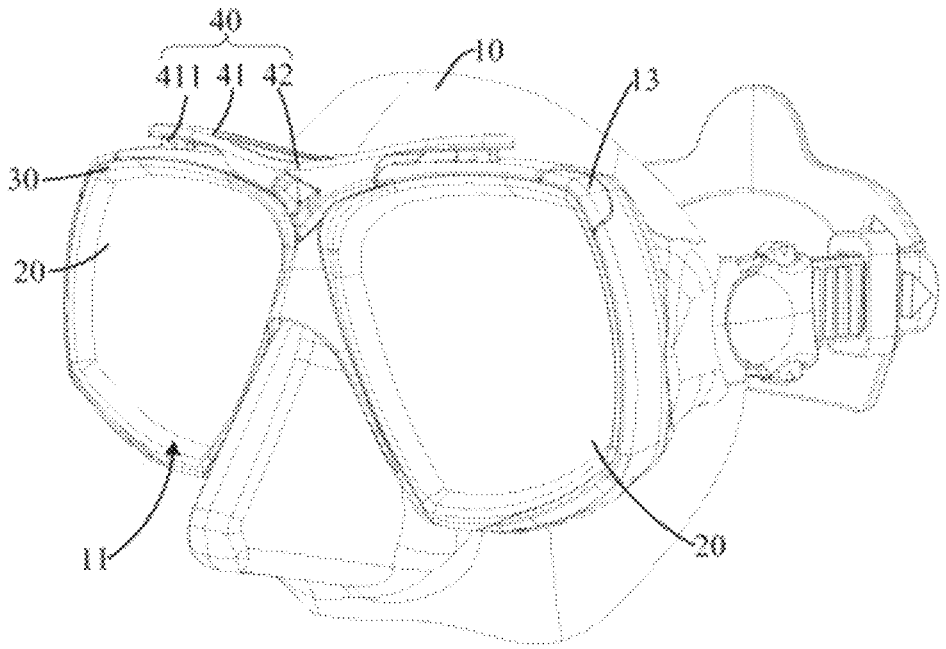
FIG. 1 is a structural diagram of diving goggles according to an exemplary embodiment of the present disclosure.

The realization of the aim, functional characteristics, advantages of the present disclosure are further described specifically with reference to the accompanying drawings and embodiments.

DETAILED DESCRIPTION OF THE EMBODIMENTS

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present invention without creative efforts shall fall within the protection scope of the present invention.

It is to be understood that, all of the directional instructions in the exemplary embodiments of the present disclosure (such as top, down, left, right, front, back . . . ) can only be used for explaining relative position relations, moving condition of the elements under a special form (referring to FIGS.), and so on, if the special form changes, the directional instructions changes accordingly.

In addition, the descriptions, such as the "first", the "second" in the exemplary embodiment of present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides diving goggles.

As shown in FIGS. 1 to 6, in that embodiment of the present disclosure, the diving goggles include:

a mask assembly 10, including a mounting hole 11, and a dismounting hole 12 passing through a side wall of the mounting hole 11;

a lens 20, installed in the mounting hole 11;

a pressing ring 30, detachably embedded in one end of the mounting hole 11 to fix the lens 20, the dismounting hole 12 facing an outer peripheral wall of the pressing ring 30; and a detaching component 40, mounted on the mask assembly 10, one end of the detaching component 40 passing through the dismounting hole 12 and resisting against the outer peripheral wall of the pressing ring 30, for detaching the pressing ring 30 from the mounting hole 11.

In the embodiment, the mask assembly 10 includes a mask body and a frame mounted on the mask body, and the frame is preferably detachably connected to the mask body. The mounting hole 11 is configured for mounting the lens 20. It is understood that the numbers of the mounting hole 11, the lens 20, and the pressing ring 30 are two respectively. The dismounting hole 12 is connected to the mounting hole 11, and may be provided in the top of the mask assembly 10 or in one side of the mask assembly 10. The pressing ring 30 may be embedded in the front end of the mounting hole 11 or in the rear end of the mounting hole 11, to press and fix the lens 20. Accordingly, the lens 20 may be inserted into the mounting hole 11 from the front end of the mounting hole 11, or from the rear end of the mounting hole 11, and the dismounting direction of the lens 20 is opposite to the mounting direction. The inner end of the pressing ring 30 abuts against the lens 20 to press and fix the lens 20 into the mounting hole 11, and the pressing ring 30 is preferably engaged with the inner wall of the mounting hole 11 to facilitate removal.

The dismounting hole 12 faces the outer peripheral wall of the pressing ring 30, and one end of the detaching component 40 passes through the mounting hole 11 to resist against the outer peripheral wall of the pressing ring 30. The shape of the detaching component 40 is not limited, and it is only necessary to satisfy that one end of the detaching component 40 can resist against the pressing ring 30. For example, the detaching component 40 may be arranged in a cylindrical shape. When the lens 20 needs to be removed, the detaching component 40 is pressed along the axial direction of the dismounting hole 12, so that pressure is applied to the pressing ring 30 through the detaching component 40. It is to be understood that the pressing ring 30 is annular and could be slightly deformed under the pressure, and the deformed pressing ring 30 is escaped from the mounting hole 11, so that the lens 20 is free and can be easily removed from the mounting hole 11. It should be noted that the detaching component 40 returns to the initial resisting position after the pressure disappears. Another lens 20 can be mounted into the mounting hole 11, then the pressing ring 30 is embedded into the mounting hole 11 to fix the lens 20 for completing the replacing process.

In the present disclosure, the lens 20 of the diving goggles is fixed in the mounting hole 11 of the mask assembly 10 through the pressing ring 30. The mask assembly 10 defines the dismounting hole 12 passing through the side wall of the mounting hole 11, the detaching component 40 passes through the dismounting hole 12 to resist against the pressing ring 30. The lens 20 can be easily removed and replaced by pressing the outer end of the detaching component 40. In detail, when the outer end of the detaching component 40 is pressed, the detaching component 40 presses the pressing ring 30 to make the pressing ring 30 to be deformed and escaped from the mounting hole 11, and the lens 20 is free and can be removed and replaced easily. When it needs to mount the lens 20, the lens 20 can be put into the mounting hole 11 first, and the pressing ring 30 is embedded into the mounting hole 11 to press the side surface of the lens 20 to fix the lens 20. Therefore, the lens 20 can be replaced conveniently.

Figure 2:
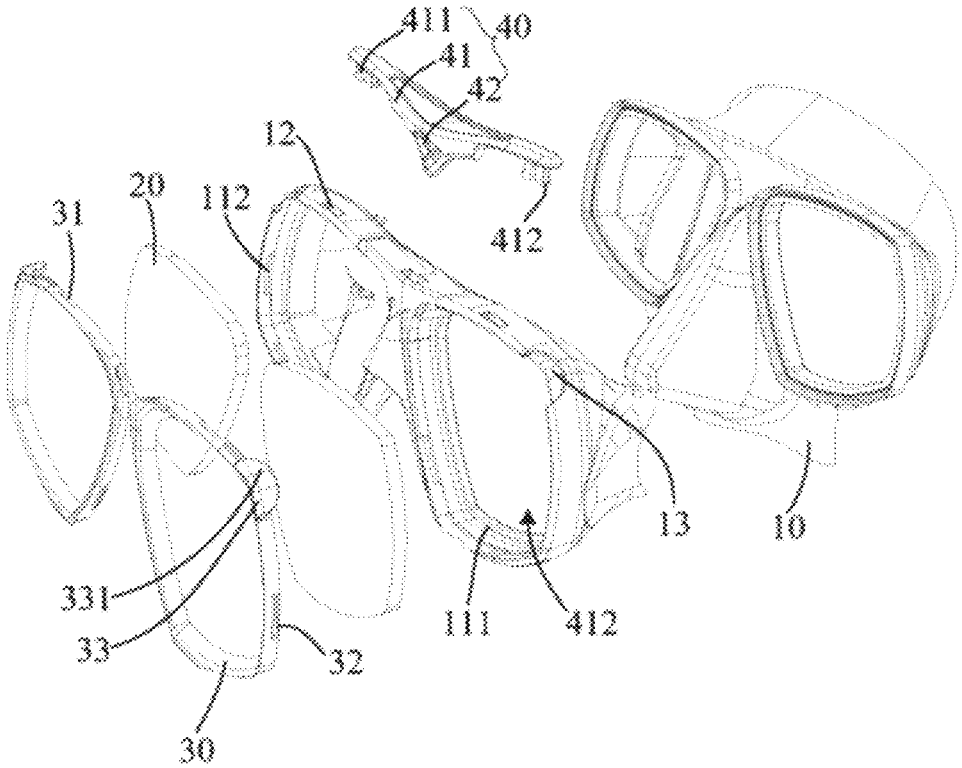
FIG. 2 is an exploded diagram of the diving goggles according to an exemplary embodiment of the present disclosure.
Figure 6:
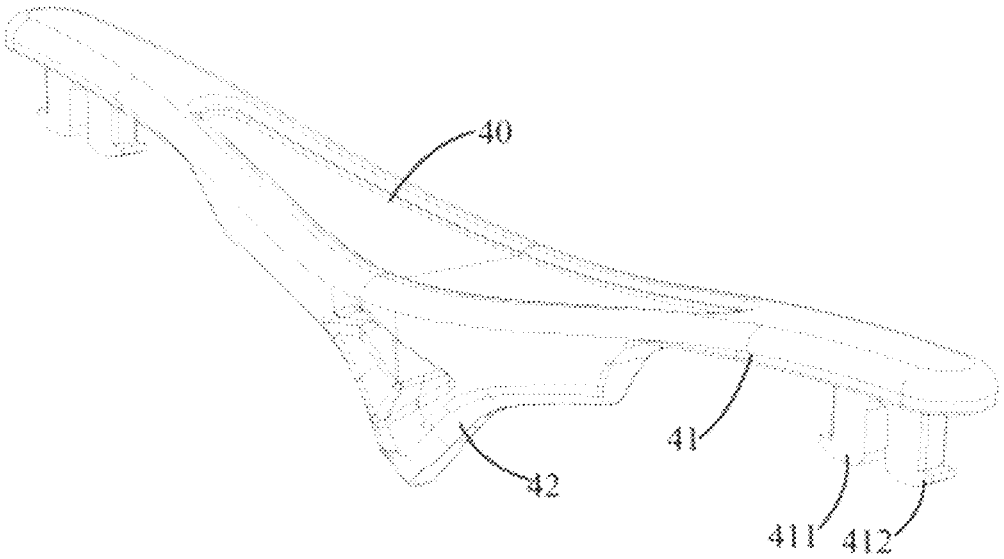
FIG. 6 is a structural diagram of a detaching component according to an exemplary embodiment of the present disclosure.

Further, as shown in FIGS. 1, 2 and 6, the detaching component 40 includes an elastic arm 41 extending along a radial direction of the dismounting hole 12, a free end of the elastic arm 41 is located on an outer side of the dismounting hole 12 along the axial direction and is configured to move elastically to approach the dismounting hole 12, and the free end of the elastic arm 41 is provided with a protruding rib 411 protruded towards the dismounting hole 23, the protruding rib 411 passes through the dismounting hole 12 and resists against the outer peripheral wall of the pressing ring 30.

In the embodiment, the elastic arm 41 extends laterally if the dismounting hole 12 is provided in the top or bottom of the mask assembly 10, and the elastic aim 41 extends longitudinally if the dismounting hole 12 is provided in one side of the mask assembly 10. One end of the elastic arm 41 is fixed to the mask assembly 10, the other end is axially spaced from an opening of the dismounting hole 12. When the free end of the elastic arm 41 is pressed along the axial direction of the dismounting hole 12, the elastic arm 41 is deformed so that its free end approaches the dismounting hole 12, at this time the protruding rib 411 is forced to press the pressing ring 30 inwards so that the pressing ring 30 is deformed and ejected out of the mounting hole 11, thereby realizing the disassembly of the lens 20. After the force disappears, the elastic arm 41 restores to its original state under its elastic action, and the free end of the elastic arm 41 restores to the initial position, so that the protruding rib 411 also restores to the initial resisting position, thereby realizing repeated disassembly and assembly of the pressing ring 30.

Figure 3:
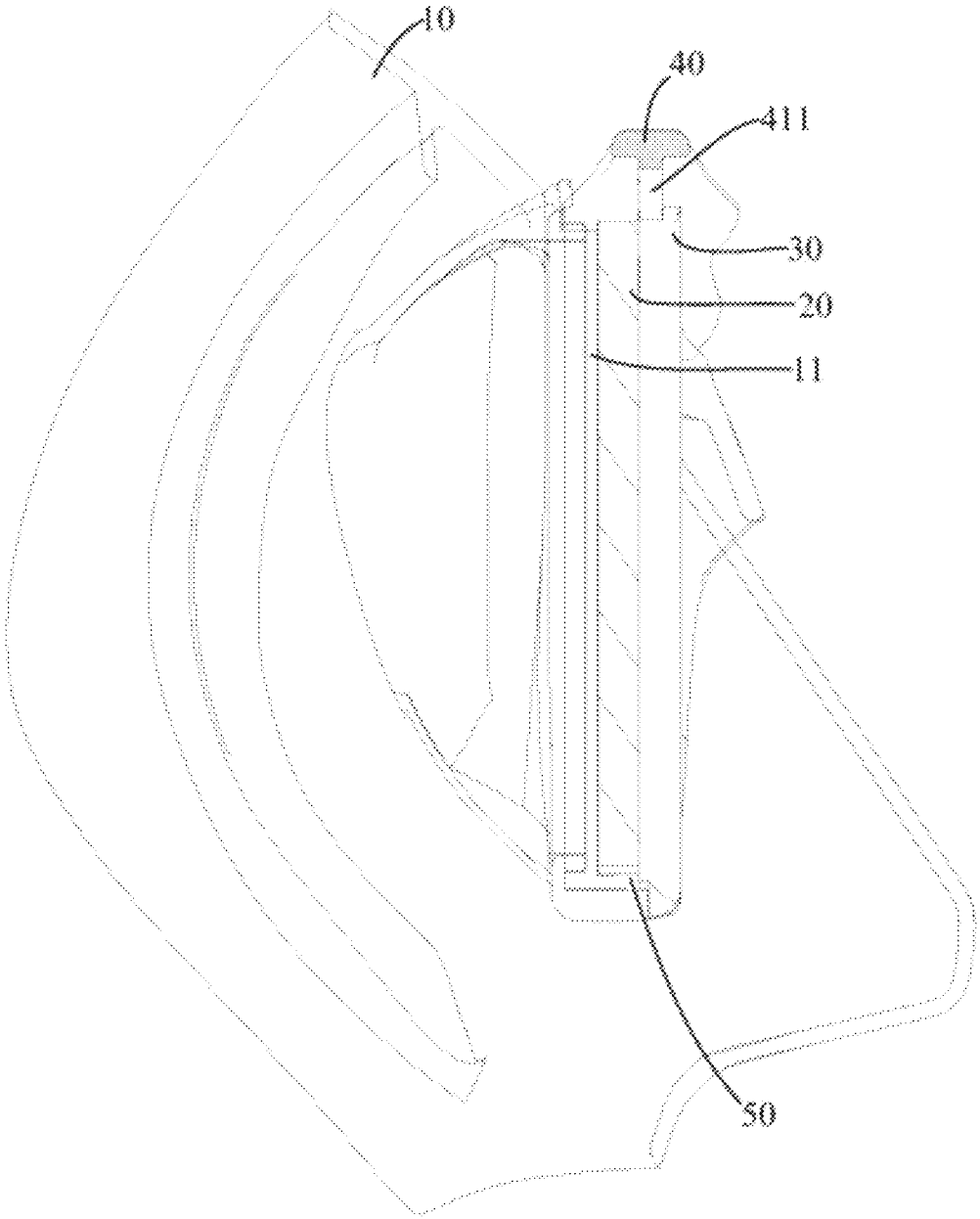
FIG. 3 is a cross sectional diagram of the diving goggles according to an exemplary embodiment of the present disclosure.

Further, as shown in FIGS. 1 to 3, the dismounting hole 12 is provided in the top of the mask assembly 10, and the detaching component 40 is also mounted at the top of the mask assembly 10. In the embodiment, the elastic arm 41 extends laterally, and preferably extends along the extending direction of the upper side of the lens 20, to effectively utilize the mounting position of the mask assembly 10 corresponding to upper side of the lens 20. And the detaching component 40 mounted on the top of the mask assembly 10 is also easier to be pressed and does not affect the overall appearance of the diving goggles.

Further, as shown in FIGS. 1 to 3, and 6, the detaching component 40 includes a fixing buckle 42, and there are two mounting holes 11, the fixing buckle 42 is mounted between the two mounting holes 11. There are two elastic arms 41 which are connected to both sides of the fixing buckle 42, respectively. In the embodiment, the fixing buckle 42 is installed between the two mounting holes 11, i.e., installed at the eyebrow center position of the mask assembly 10, and the shape of the fixing buckle 42 preferably corresponds to the shape of the eyebrow center position so as to make the overall appearance of the diving goggles more beautiful. The elastic arm 41 extends laterally from both sides of the fixing buckle 42, so that the two elastic arms 41 are mounted on the same fixing buckle 42, so that the detaching component 40 can be defined as a separate unit, effectively preventing the detaching component 40 from being lost. In practical application, the elastic arm 41 is integrally arranged with the fixing buckle 42 to facilitate production and processing.

Further, as shown in FIGS. 1 to 3, the pressing ring 30 is embedded in the front end of the mounting hole 11. In the embodiment, the pressing ring 30 is embedded in the front end of the mounting hole 11, that is, the pressing ring 30 is embedded into the mounting hole 11 from the front side of the mask assembly 10, and the lens 20 is also mounted into or detached from the mounting hole 11 the front end of the mounting hole 11. Since the rear side of the mask assembly 10 is generally semi-enclosed, if the pressing ring 30 and the lens 20 are removed from the rear side of the mask assembly 10, the mask body impedes the disassembly and assembly of the pressing ring 30 and the lens 20, making the replacement of the lens 20 inconvenient. In order to broaden the scope of the diving goggles, redundant structures are generally prevented from setting at the front side of the mask assembly 10. Therefore, the process of embedding the pressing ring 30 in the front end of the mounting hole 11, i.e., detaching and replacing the pressing ring 30 and the lens 20 from the front side of the mask assembly 10, would not be hindered by other structures of the diving goggles, thereby facilitating the replacement and removal of the lens 20 and improving the convenience of the diving goggles.

Figure 4:
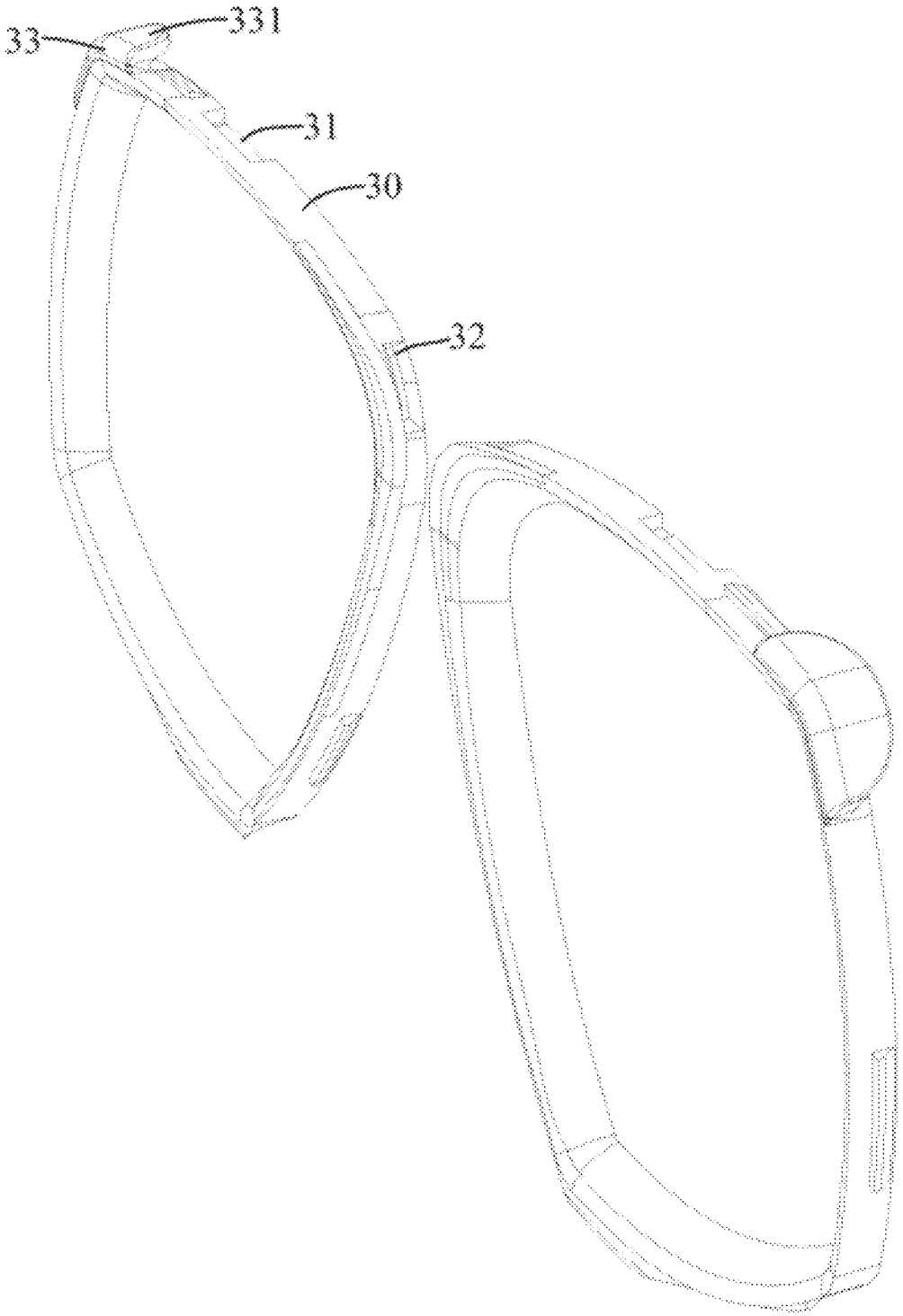
FIG. 4 is a structural diagram of a pressing ring according to an exemplary embodiment of the present disclosure.
Figure 5:
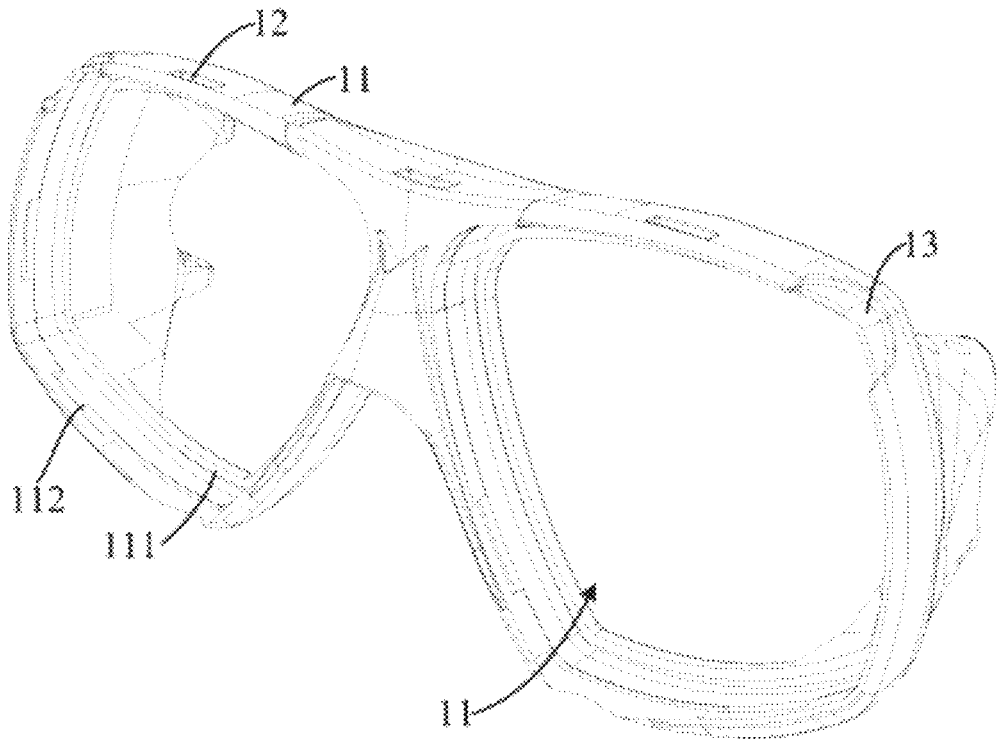
FIG. 5 is a structural diagram of a mask assembly according to an exemplary embodiment of the present disclosure.

Further, as shown in FIG. 4, a detaching step 31 is concavely provided at the top of the inner end of the pressing ring 30, and the protruding rib 411 resists against the detaching step 31. In the embodiment, the detaching step 31 enables the protruding rib 411 to more accurately transmit the force applied to the protruding rib 411 to the pressing ring 30, and prevents the protruding rib 411 from being misaligned. Meanwhile, the detaching step 31 can make the protruding rib 411 extrude the pressing ring 30 outwardly when the protruding rib 411 extrudes the pressing ring 30, so that the pressing ring 30 can eject more smoothly from the mounting hole 11, thereby avoiding serious deformation or damage of the pressing ring 30 due to improper force, and improving the stability of the whole diving goggles.

Further, as shown in FIGS. 1 to 5, a fixing step 111 is formed at the front end of the mounting hole 11, a wall of the rear end of the pressing ring 30 is enclosed with the fixing step 111 to form a receiving groove 50 extending along the circumferential direction, and a side edge of the lens 20 is embedded in the receiving groove 50. In the embodiment, the rear wall and the side wall of the lens 20 resist against the fixing step 111, and the front wall of the lens 20 resists against the wall of the rear end of the pressing ring, so that the lens 20 is securely mounted in the mounting hole 11 via the pressing ring 30. In practical application, a buffer gap is also defined between the lens 20 and the receiving groove 50 to prevent the lens 20 from being damaged due to excessive compression, thereby improving the stability of the diving goggles.

Further, as shown in FIGS. 2 to 4, the outer peripheral wall of the pressing ring 30 is protruded with a fixing rib 32, and the inner wall of the mounting hole 11 is provided with a fixing groove 112 matched with the fixing rib 32. In the embodiment, the fixing rib 32 extends along the circumferential direction of the lens 20, and there are several fixing ribs which are spaced from each other along the circumferential direction, and the shape and number of the fixing groove 112 correspond to the fixing rib 32, thereby making the engagement of the pressing ring 30 with the mounting hole 11 more stable. In practical application, the pressing ring 30 is also closely matched with the mounting hole 11 and the lens 20 to prevent water leakage during diving.

Further, as shown in FIGS. 2 to 4, the front end of the outer peripheral wall of the pressing ring 30 is protruded with a connecting rib 33, a free end of the connecting rib 33 extends rearwards to form a positioning rib 331, and the mask assembly 10 is concavely provided with a positioning groove 13 matched with the positioning rib 331. In the embodiment, the number of the positioning ribs 331 is two and the two positioning ribs 331 are located on both sides of the pressing ring 30 in the circumferential direction, and the sizes of the two positioning ribs 331 are preferably different, thereby facilitating the user to quickly distinguish the correct mounting angle when the pressing ring 30 is embedded, improving the mounting efficiency, and thereby improving the convenience of changing the lens 20 of the diving goggles.

In practical application, a rounded corner of the pressing ring 30 is defined as a rectangular frame with rounded corners, the positioning rib 331 are preferably disposed at four corners of the pressing ring 30, the positioning groove 13 is provided in the corresponding positions of the mask assembly 10. When the pressing ring 30 is installed, the four positioning ribs 331 are pressed into the corresponding positioning groove 13 to position and fix the pressing ring 30, thereby fixing the pressing ring 30 and facilitating the user to quickly judge whether the pressing ring 30 is fixed in place, so that improving the convenience of changing the lens of the diving goggles.

Further, as shown in FIGS. 2 and 6, the free end of the protruding rib 411 is protruded with a clamping member 412, and the clamping member 412 is clamped with the inner wall of the mounting hole 11. The clamping member 412 is engaged with the inner wall of the mounting hole 11 to prevent the protruding rib 411 from disengaging from the dismounting hole 12. The number of the ribs 411 corresponding to each of the dismounting holes 12 is preferably two, and the clamping members 412 on the two protruding ribs 411 extend in opposite directions, so that the clamping member 412 can be more firmly engaged with the inner wall of the mounting hole 11 and the structural strength of the entire detaching component 40 is improved. In practical application, when it needs to detach the pressing ring 30, it is necessary to apply a certain force to the free end of the elastic arm 41 to effectively press the protruding rib 411, thereby squeezing the pressing ring 30 out of the mounting hole 11. Therefore, even if the free end of the elastic arm 41 is accidentally touched, the pressing ring 30 will not be easily ejected out of the mounting hole under the use state of the diving goggles, thereby improving its stability.

The foregoing description merely portrays some illustrative embodiments according to the disclosure and therefore is not intended to limit the patentable scope of the disclosure. Any equivalent structural or flow transformations that are made taking advantage of the specification and accompanying drawings of the disclosure and any direct or indirect applications thereof in other related technical fields shall all fall in the scope of protection of the disclosure. Therefore, the scope of protection of this disclosure shall be subject to the claims.

What is claimed is:

1. Diving goggles, comprising:

a mask assembly, comprising a mounting hole, and a dismounting hole passing through a side wall of the mounting hole:

a lens, installed in the mounting hole;

a pressing ring, detachably embedded in one end of the mounting hole to fix the lens, the dismounting hole facing an outer peripheral wall of the pressing ring; and a detaching component, mounted on the mask assembly, one end of the detaching component passing through the dismounting hole and resisting against the outer peripheral wall of the pressing ring, for detaching the pressing ring from the mounting hole, wherein:

the detaching component comprises an elastic arm extending along a radial direction of the dismounting hole, a free end of the elastic arm is located on an outer side of the dismounting hole along the axial direction and is configured to move elastically to approach the dismounting hole, and the free end of the elastic arm is provided with a protruding rib protruded towards the dismounting hole, the protruding rib passes through the dismounting hole and resists against the outer peripheral wall of the pressing ring.

2. The diving goggles according to claim 1, wherein the dismounting hole is provided in a top of the mask assembly, and the detaching component is installed at the top of the mask assembly.

3. The diving goggles according to claim 2, wherein the detaching component comprises a fixing buckle, and a number of mounting holes is two, the fixing buckle is installed between the two mounting holes; and a number of elastic arms is two, and the two elastic arms are connected to both sides of the fixing buckle respectively.

4. The diving goggles according to claim 3, wherein the outer peripheral wall of the pressing ring is protruded with a fixing rib, and an inner wall of the mounting hole is provided with a fixing groove matched with the fixing rib.

5. The diving goggles according to claim 3, wherein a free end of the protruding rib is protruded with a clamping member, and the clamping member is clamped with an inner wall of the mounting hole.

6. The diving goggles according to claim 2, wherein the outer peripheral wall of the pressing ring is protruded with a fixing rib, and an inner wall of the mounting hole is provided with a fixing groove matched with the fixing rib.

7. The diving goggles according to claim 2, wherein a free end of the protruding rib is protruded with a clamping member, and the clamping member is clamped with an inner wall of the mounting hole.

8. The diving goggles of according to claim 1, wherein the pressing ring is embedded in a front end of the mounting hole.

9. The diving goggles according to claim 8, wherein a detaching step is concavely provided at a top of a rear end of the pressing ring, and the protruding rib is configured to resist against the detaching step.

10. The diving goggles according to claim 9, wherein the outer peripheral wall of the pressing ring is protruded with a fixing rib, and an inner wall of the mounting hole is provided with a fixing groove matched with the fixing rib.

11. The diving goggles according to claim 8, wherein a fixing step is formed at the front end of the mounting hole, a rear end of the pressing ring is enclosed with the fixing step to form a receiving groove extending along a circumferential direction, and the lens is embedded in the receiving groove.

12. The diving goggles according to claim 11, wherein the outer peripheral wall of the pressing ring is protruded with a fixing rib, and an inner wall of the mounting hole is provided with a fixing groove matched with the fixing rib.

13. The diving goggles according to claim 8, wherein a connecting rib is protruded at a front end of the outer peripheral wall of the pressing ring, a free end of the connecting rib extends rearwards to form a positioning rib, and the mask assembly is concavely provided with a positioning groove matched with the positioning rib.

14. The diving goggles according to claim 13, wherein the outer peripheral wall of the pressing ring is protruded with a fixing rib, and an inner wall of the mounting hole is provided with a fixing groove matched with the fixing rib.

15. The diving goggles according to claim 8, wherein the outer peripheral wall of the pressing ring is protruded with a fixing rib, and an inner wall of the mounting hole is provided with a fixing groove matched with the fixing rib.

16. The diving goggles according to claim 8, wherein a free end of the protruding rib is protruded with a clamping member, and the clamping member is clamped with an inner wall of the mounting hole.

17. The diving goggles according to claim 1, wherein the outer peripheral wall of the pressing ring is protruded with a fixing rib, and an inner wall of the mounting hole is provided with a fixing groove matched with the fixing rib.

18. The diving goggles according to claim 1, wherein a free end of the protruding rib is protruded with a clamping member, and the clamping member is clamped with an inner wall of the mounting hole.

* * * * *